US010983480B2

(12) United States Patent
Ukawa et al.

(10) Patent No.: US 10,983,480 B2
(45) Date of Patent: Apr. 20, 2021

(54) ELECTRONIC TIMEPIECE AND CONTROL METHOD

(71) Applicant: SEIKO EPSON CORPORATION, Tokyo (JP)

(72) Inventors: Masaki Ukawa, Chino (JP); Yasuhiro Momose, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 436 days.

(21) Appl. No.: 15/928,230

(22) Filed: Mar. 22, 2018

(65) Prior Publication Data

US 2018/0275613 A1 Sep. 27, 2018

(30) Foreign Application Priority Data

Mar. 23, 2017 (JP) ..... JP2017-057870

(51) Int. Cl.

| | |
|---|---|
| ***G04C 10/00*** | (2006.01) |
| ***G04B 47/06*** | (2006.01) |
| ***G04G 21/02*** | (2010.01) |
| ***G04C 3/14*** | (2006.01) |

(52) U.S. Cl.

CPC ..... *G04B 47/06* (2013.01); *G04C 3/146* (2013.01); *G04G 21/02* (2013.01); *G04G 21/025* (2013.01); *G04B 47/068* (2013.01); *G04C 10/00* (2013.01)

(58) Field of Classification Search

CPC ..... G04C 10/00; G04C 10/04; G04B 47/06; G04G 21/02

See application file for complete search history.

(56) References Cited

U.S. PATENT DOCUMENTS

| | | | | |
|---|---|---|---|---|
| 7,215,601 | B2 * | 5/2007 | Plancon | G04B 19/082 368/10 |
| 7,623,415 | B2 * | 11/2009 | Raeber | B63C 11/32 368/10 |
| 10,089,714 | B2 * | 10/2018 | Roberts | G06T 11/206 |
| 2013/0033970 | A1 * | 2/2013 | Miyake | G04C 17/00 368/80 |
| 2015/0257658 | A1 * | 9/2015 | Geesbreght | A61B 5/0205 600/301 |
| 2015/0323906 | A1 * | 11/2015 | Yang | G04G 19/12 368/224 |
| 2017/0075316 | A1 * | 3/2017 | Berdinis | G04G 19/12 |
| 2017/0277137 | A1 * | 9/2017 | Iijima | G04C 10/04 |

(Continued)

FOREIGN PATENT DOCUMENTS

| | | | |
|---|---|---|---|
| CN | 103019384 | A | 4/2013 |
| CN | 103516912 | A | 1/2014 |

(Continued)

*Primary Examiner* — Edwin A. Leon
*Assistant Examiner* — Jason M Collins
(74) *Attorney, Agent, or Firm* — Oliff PLC

(57) ABSTRACT

An electronic timepiece includes a measuring section that measures a predetermined measurement item, a display capable of displaying the result of the measurement performed by the measuring section, a battery that supplies electric power for driving the measuring section and the display, and a processor including an action controller that prevents switching to a display mode that causes the display to display the measurement result in a case where the remaining battery level of the battery is lower than a predetermined value.

3 Claims, 6 Drawing Sheets

(56) References Cited

U.S. PATENT DOCUMENTS

| | | | | |
|---|---|---|---|---|
| 2018/0060175 | A1* | 3/2018 | Kim | G06F 16/489 |
| 2018/0181078 | A1* | 6/2018 | Imamura | G04G 9/02 |
| 2019/0117081 | A1* | 4/2019 | Yamashita | A61B 5/7445 |

FOREIGN PATENT DOCUMENTS

| | | | |
|---|---|---|---|
| JP | S63-73183 | A | 4/1988 |
| JP | 2013-057517 | A | 3/2013 |

* cited by examiner

ELECTRONIC TIMEPIECE AND CONTROL METHOD

CROSS-REFERENCE TO RELATED APPLICATION

This nonprovisional application claims the benefit of Japanese Patent Application No. 2017-057870, filed Mar. 23, 2017, the entire disclosure of which is incorporated herein by reference.

BACKGROUND

1. Technical Field

The present invention relates to an electronic timepiece and a control method.

2. Related Art

There has been a known electronic timepiece that indicates the current time with the hour and minute hands and indicates a physical quantity, such as a measured temperature, with an information indicating hand (see JP-A-2013-57517, for example).

The electronic timepiece described in JP-A-2013-57517, which is configured to measure the current time, further includes a temperature sensor that detects the outside temperature and a temperature sensor controller that controls energization of the temperature sensor and the measurement cycle for the temperature measurement. In the electronic timepiece, the time is indicated with the hour and minute hands rotated over the entire dial around the center of the dial. The temperature measured with the temperature sensor is indicated with a small hand provided in the nine-o'clock position of the dial and located in a marking section.

The electronic timepiece described above further includes a motor that drives and rotates the information indicating hand described above, a battery that supplies the motor with electric power, a voltage detector that detects the voltage across the battery, and a CPU that controls the entire timepiece. When the battery voltage (battery level) detected with the voltage detector lowers, the CPU increases a numeral range specified by a displayed temperature maximum value and a displayed temperature minimum value in accordance with the battery voltage to reduce the amount of rotation of the driven small hand described above. The operation described above allows the operation of displaying the physical quantity with the small hand until the drive voltage reaches its limit.

In the case where the remaining battery level decreases, not only the value measured with the sensor but the current time that should be always displayed could not be displayed if a power saving process, such as that carried out in the electronic timepiece described in JP-A-2013-57517, is not carried out. An electronic timepiece capable of measuring a predetermined physical quantity is therefore desired to have a configuration that allows reduction in consumed power.

SUMMARY

An advantage of some aspects of the invention is to provide an electronic timepiece and a control method that allow reduction in power consumption.

An electronic timepiece according to a first aspect of the invention includes a measuring section that measures a predetermined measurement item, a display capable of displaying a result of the measurement performed by the measuring section, a battery that supplies electric power for driving the measuring section and the display, and a processor including an action controller that prevents switching to a display mode that causes the display to display the measurement result in a case where a remaining battery level of the battery is lower than a predetermined value.

According to the first aspect described above, when the remaining battery level is lower than the predetermined value, switching to the display mode described above is not allowed, whereby the display is at least not allowed to display the measurement result. Consumption of electric power necessary for the operation of displaying the measurement result can therefore be suppressed in each of the following cases: in a configuration in which the display includes a display that displays the measurement result; and a case where the display includes an indicating hand that indicates the measurement result. The power consumption of the electronic timepiece can therefore be suppressed.

In the first aspect described above, it is preferable that the action controller prevents the measuring section from performing the measurement when the remaining battery level is lower than the predetermined value.

According to the configuration described above, not only is the display not allowed to display the measurement result, but the measuring section is not allowed to perform the measurement, whereby the power consumption of the electronic timepiece can be further suppressed.

An electronic timepiece according to a second aspect of the invention includes a measuring section that measures a predetermined measurement item, a display including an upper digit display hand that indicates a numeral at an upper digit of a value measured by the measuring section and a lower digit display hand that indicates a numeral at a lower digit of the measured value, a battery that supplies electric power for driving the measuring section and the display, and a processor including an action controller that prevents one of the upper digit display hand and the lower digit display hand from displaying the corresponding numeral when a remaining battery level of the battery is lower than a predetermined value.

According to the second aspect described above, when the remaining battery level is lower than the predetermined value, one of the upper digit display hand and the lower digit display hand is not allowed to indicate the corresponding numeral, whereby the electric power necessary for the operation of driving the one display hand is not consumed. The power consumption of the electronic timepiece can therefore be suppressed.

In the second aspect described above, it is preferable that the measurement item is formed of a plurality of measurement items, that the measuring section is configured to be capable of measuring the plurality of measurement items, and that out of the upper digit display hand and the lower digit display hand, the display hand that is not allowed to display the corresponding numeral is set in accordance with which of the measurement items is measured.

According to the configuration described above, preventing a display hand other than a display hand that displays a digit where a large change occurs or which is important in a measurement item from displaying a measured value allows suppression of the power consumption with a minimum numeral required in the measurement displayed.

An electronic timepiece according to a third aspect of the invention includes a measuring section that measures a predetermined measurement item, a display capable of displaying a result of the measurement performed by the measuring section, a processor that controls an action of the entire electronic timepiece, and a battery that supplies electric power for driving the measuring section and the display, and the processor causes the display to display an average of results of the measurement performed multiple times in accordance with a first number when a remaining battery level of the battery is higher than or equal to a predetermined value and causes the display to display an average of results of the measurement performed multiple times in accordance with a second number smaller than the first number when the remaining battery level is lower than the predetermined value.

According to the third aspect described above, the display displays the average of results of the measurement performed by multiple times in accordance with the number according to the remaining battery level. As a result, the number of measurement actions in the case where the remaining battery level is lower than the predetermined value, that is, the number of measurement results necessary for the calculation of the average can be reduced as compared with the case where the remaining battery level is higher than or equal to the predetermined value. Therefore, when the remaining battery level is lower than the predetermined value, the consumed power necessary for the computation of the average can be lowered, whereby the power consumption of the electronic timepiece can be suppressed.

In the third aspect described above, it is preferable that the processor causes the measuring section to perform the measurement multiple times in accordance with the first number when the remaining battery level is higher than or equal to the predetermined value and causes the measuring section to perform the measurement multiple times in accordance with the second number when the remaining battery level is lower than the predetermined value.

According to the configuration described above, the number of measurement actions in the case where the remaining battery level is lower than the predetermined value can be smaller than the number of measurement actions in the case where the remaining battery level is higher than or equal to the predetermined value. That is, the number of measurement actions performed when the remaining battery level is lower than the predetermined value can be reduced as compared with the case where the remaining battery level is higher than or equal to the predetermined value. The consumed electric power necessary for the measurement performed by the measuring section can therefore be lowered when the remaining battery level is lower than the predetermined value, whereby the power consumption of the electronic timepiece can be suppressed.

A control method according to a fourth aspect of the invention is a method for controlling an electronic timepiece including a measuring section that measures a predetermined measurement item, a display capable of displaying a result of the measurement performed by the measuring section, and a battery that supplies electric power for driving the measuring section and the display, the method including preventing switching to a display mode that causes the display to display the measurement result when a remaining battery level of the battery is lower than a predetermined value.

The fourth aspect described above, in which the control method is performed by using the electronic timepiece described above, can provide the same effects as those provided by the electronic timepiece according to the first aspect described above.

A control method according to a fifth aspect of the invention is a method for controlling an electronic timepiece including a measuring section that measures a predetermined measurement item, a display including an upper digit display hand that indicates a numeral at an upper digit of a value measured by the measuring section and a lower digit display hand that indicates a numeral at a lower digit of the measured value, and a battery that supplies electric power for driving the measuring section and the display, the method including preventing one of the upper digit display hand and the lower digit display hand from displaying the corresponding numeral when a remaining battery level of the battery is lower than a predetermined value.

The fifth aspect described above, in which the control method is performed by using the electronic timepiece described above, can provide the same effects as those provided by the electronic timepiece according to the second aspect described above.

A control method according to a sixth aspect of the invention is a method for controlling an electronic timepiece including a measuring section that measures a predetermined measurement item, a display capable of displaying a result of the measurement performed by the measuring section, and a battery that supplies electric power for driving the measuring section and the display, the method including displaying an average of results of the measurement performed multiple times in accordance with a first number when a remaining battery level of the battery is higher than or equal to a predetermined value and displaying an average of results of the measurement performed multiple times in accordance with a second number smaller than the first number when the remaining battery level is lower than the predetermined value.

The sixth aspect described above, in which the control method is performed by using the electronic timepiece described above, can provide the same effects as those provided by the electronic timepiece according to the third aspect described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

A first embodiment according to the invention will be described below with reference to the drawings.

Schematic Configuration of Electronic Timepiece

Figure 1:
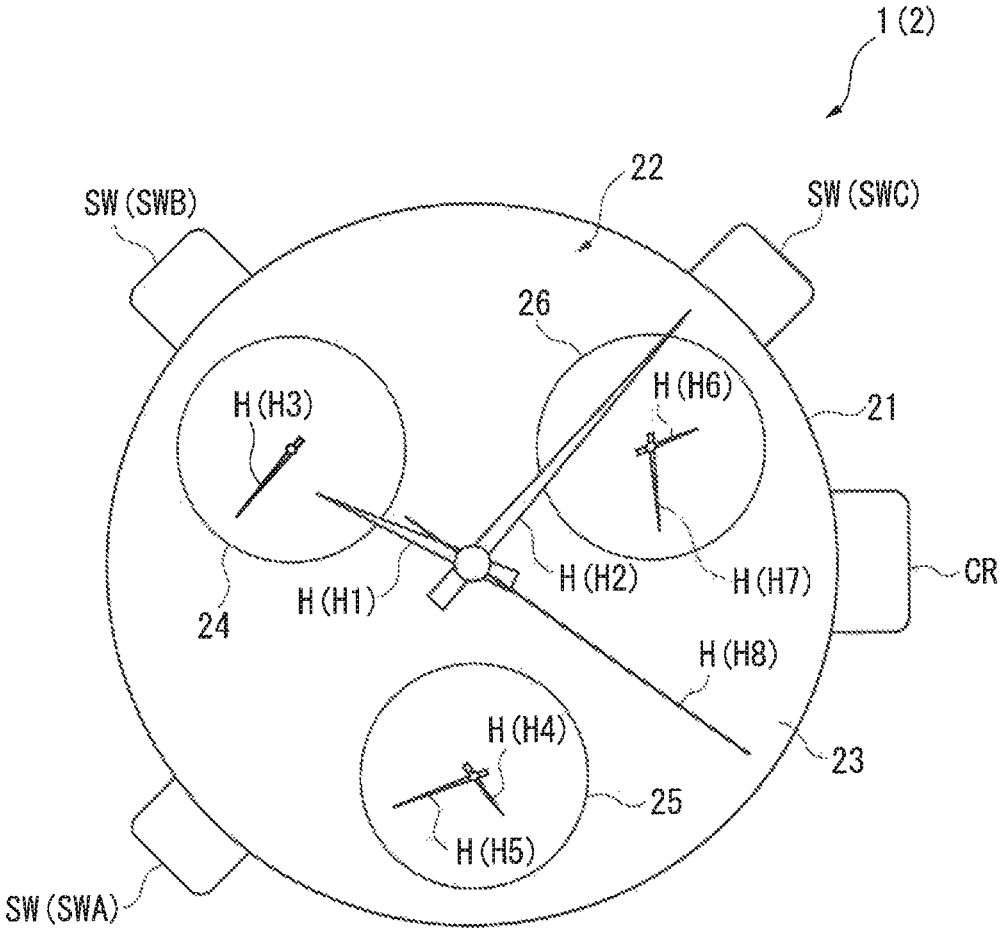
FIG. 1 is a diagrammatic view of an electronic timepiece according to a first embodiment of the invention.

FIG. 1 is a front view showing an electronic timepiece 1 according to the present embodiment.

The electronic timepiece 1 according to the present embodiment is a wearable apparatus configured to allow a user to carry it and worn and used by the user and is an analog electronic timepiece in which hands indicate the current time and the result of measurement performed by a sensor. The electronic timepiece 1 (hereinafter abbreviated to timepiece 1 in some cases) includes a timepiece body 2 and a band (not shown) that allows the timepiece body 2 to be worn on the user's body (wrist, for example).

Configuration of Timepiece Body

The timepiece body 2 includes an enclosure 21, which has a roughly circular shape in a front view, and a display 22.

The enclosure 21 has three switches SW (SWA to SWC), which protrude from the side surface of the enclosure 21, and one crown CR.

The switches SWA to SWC are disposed in positions in a roughly 8-o'clock direction, a roughly 10-o'clock direction, and a roughly 2-o'clock direction, respectively, and form an operation section that accepts the user's input operation (pressing operation). The switches SWA to SWC each output an operation signal according to the input operation to a processor 40 (see FIG. 2), which will be described later.

The crown CR is used to operate indicating hands H (hour hand H1 and minute hand H2, for example), which will be described later.

The display 22 includes a circular dial 23 and a plurality of indicating hands H (hour hand H1, minute hand H2, second hand H3, mode hand H4, remaining quantity hand H5, and display hands H6 to H8), which are so provided on the dial 23 as to be pivotable. The indicating hands H are caused to pivot by a driver 37, which will be described later.

The dial 23 is disposed on the front side of the enclosure 21 and has three small windows 24 to 26.

The hour hand H1, the minute hand H2, and the display hand H8 are so rotatably provided as to have coaxial rotary shafts roughly at the center of the dial 23.

The small window 24 is disposed in a position in a roughly 10-o'clock direction on the dial 23. The second hand H3 is rotatably disposed in the small window 24.

The small window 25 is disposed in a position in a roughly 6-o'clock direction on the dial 23. The mode hand H4 and the remaining quantity hand H5 are so pivotably disposed in the small window 25 as to have coaxial pivotal shafts roughly at the center of the small window 25. Out of the two hands, the mode hand H4 is a hand that points the current action mode of the timepiece 1, and the remaining quantity hand H5 is a hand that points the remaining battery level of a secondary battery 33 (see FIG. 2) built in the enclosure 21.

The small window 26 is disposed in a position in a roughly 2-o'clock direction on the dial 23. The display hands H6 and H7 are so rotatably disposed in the small window 26 as to have coaxial rotary shafts. Out of the two hands, the display hand H7 is longer than the display hand H6 but shorter than the display hand H8. That is, out of the display hands H6 to H8, the display hand H8 is the longest, and the display hand H6 is the shortest.

The timepiece 1 (timepiece body 2), when it shows the result of measurement performed by a measuring section 38 (see FIG. 2), which will be described later, and the result of measurement received from a measuring apparatus (not shown) that is an external apparatus, can cause the display hands H6 to H8 described above to point a four-digit numeral. In the present embodiment, the four-digit numeral is so indicated that the numeral at the upper first digit (numeral at thousand's place, for example) is indicated with the display hand H6, the numeral at the upper second digit (numeral at hundred's place, for example) is indicated with the display hand H7, and the numerals at the upper third and fourth digits (numerals at ten's place and one's place, for example) are indicated with the display hand H8. The same holds true for a case where numerals after the decimal point are indicated. That is, the display hands H6 and H7, which each make one turn, each indicate values "0" to "9", and the display hands H8, which makes one turn, indicates values "00" to "99".

Internal Configuration of Electronic Timepiece

Figure 2:
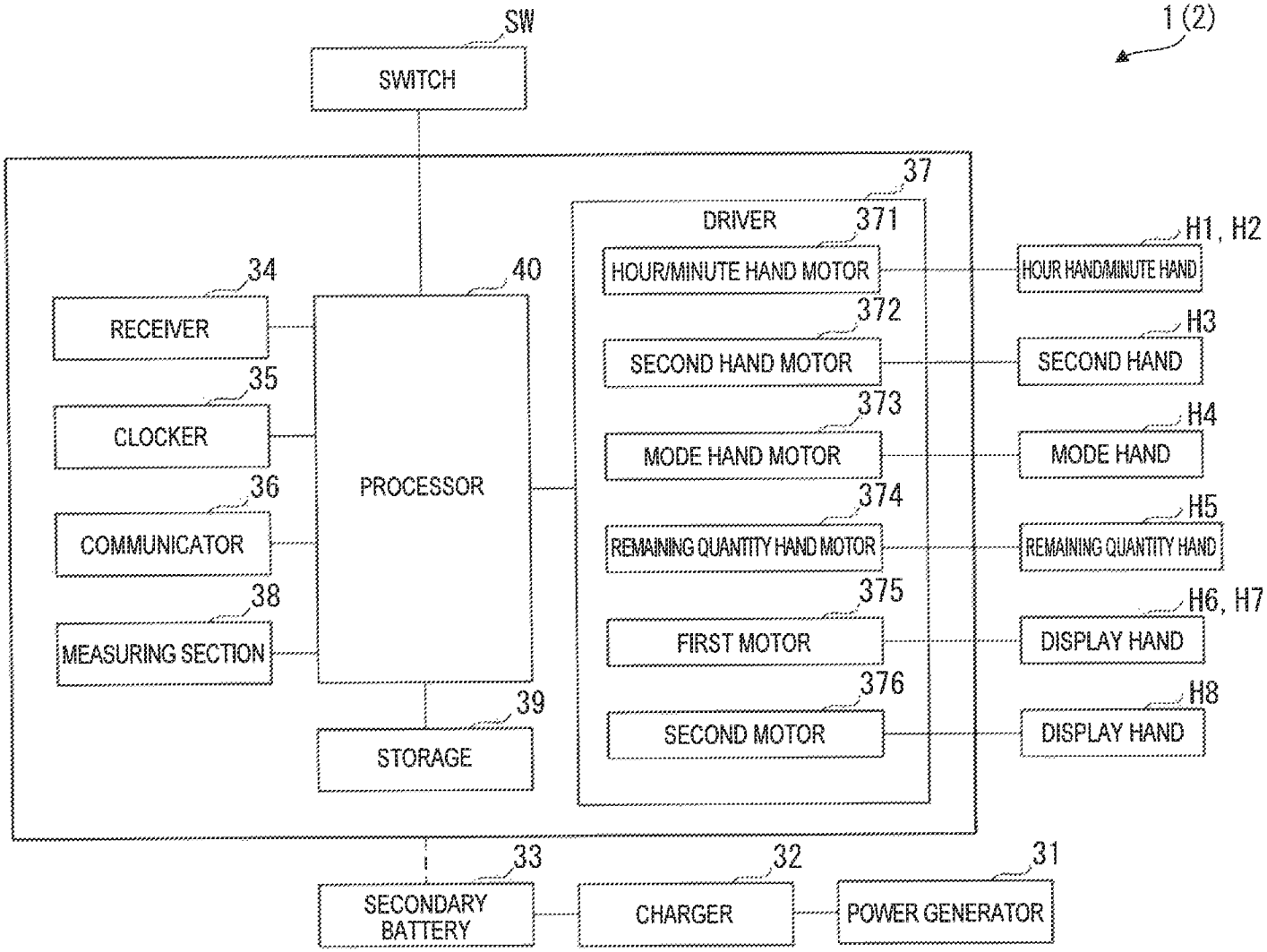
FIG. 2 is a block diagram showing the configuration of the electronic timepiece in the first embodiment.

FIG. 2 is a block diagram showing the internal configuration of the timepiece 1.

The timepiece 1 includes a power generator 31, a charger 32, a secondary battery 33, a receiver 34, a clocker 35, a communicator 36, a driver 37, a measuring section 38, a storage 39, and a processor 40 as well as the configuration described above, as shown in FIG. 2.

The power generator 31 generates electric power with which the secondary battery 33 is charged. In the present embodiment, the power generator 31 is a solar panel including a plurality of solar cells (photovoltaic devices) that each convert optical energy into electrical energy (electric power), but not necessarily, and the power generator 31 may instead generate electric power by rotating a rotary weight.

The charger 32 charges the secondary battery 33 with the electric power generated by the power generator 31.

The secondary battery 33 is a battery that supplies the timepiece body 2 with drive electric power. The remaining battery level of the secondary battery 33 is indicated with the remaining quantity hand H5 described above.

The receiver 34 receives date/time information contained in a satellite signal, such as a GPS (global positioning system) signal, a standard electric wave, or any other medium. The date/time information reception performed by the receiver 34 is controlled by the processor 40 and performed, for example, when an operation signal according to the operation of pressing the switch SWB described above or when preset time is reached.

The clocker 35 clocks the current date and time. The current date and time is corrected based on the date/time information received by the receiver 34.

The communicator 36 communicates with an external apparatus under the control of the processor 40. The thus configured communicator 36 can be formed of a communication module capable of communicating with an external apparatus, for example, by using a communication method according to IEEE 802.15 or any other short-range wireless communication standard or a communication method according to IEEE 802.16, LTE (long term evolution), or any other communication standard. An example of the former communication method may be Bluetooth (registered trademark).

The driver 37 causes the indicating hands H described above to pivot (move) under the control of the processor 40 and forms the display 22 described above. In the present embodiment, the driver 37 includes a plurality of stepper motors.

In detail, the driver 37 includes a hour/minute hand motor 371, which causes the hour hand H1 and the minute hand H2 to pivot (rotate), a second hand motor 372, which causes the second hand H3 to pivot, a mode hand motor 373, which causes the mode hand H4 to pivot, a remaining quantity hand motor 374, which causes the remaining quantity hand H5 to pivot, a first motor 375, which causes the display hands H6 and H7 to pivot, and a second motor 376, which causes the display hand H8 to pivot. The motors are individually driven under the control of the processor 50.

The measuring section 38 measures predetermined measurement items. Examples of the measurement items may include measurement items relating to the user's biological body and body motion and measurement items relating to the environment around the timepiece 1. Specifically, the measuring section 38 includes an orientation sensor that measures the orientation and an atmospheric pressure sensor that measures the atmospheric pressure. The measuring section 38 further measures the altitude based on the measured atmospheric pressure. The measuring section 38 then outputs measurement results on the measurement items (orientation, atmospheric pressure, and altitude) to the processor 40.

The measuring section 38 may include a pulse wave sensor that detects the pulse wave to measure the pulse rate and an acceleration sensor that detects the user's body motion (specifically, acceleration produced by body motion) as sensors that measures information on the user's biological body and body motion. The measuring section 38, in the case where it includes the acceleration sensor, can measure the number of steps made by the user and calorie consumed by the user based on the result of the detection performed by the acceleration sensor. The measuring section 38 may further include an ultraviolet sensor and a temperature sensor as sensors that measure information on the surrounding environment described above.

The storage 39 is formed of a nonvolatile memory, such as a flash memory, and stores a variety of programs and data necessary for the action of the timepiece 1. the storage 39 stores, as one of the programs, a power-saving program for carrying out a power saving process carried out by the processor 40 when the remaining battery level of the secondary battery 33 described above is lower than a predetermined value (when battery voltage is lower than predetermined value). The storage 39 further stores values measured by the measuring section 38 with the values related to the current date and time clocked with the clocker 35.

Figure 3:
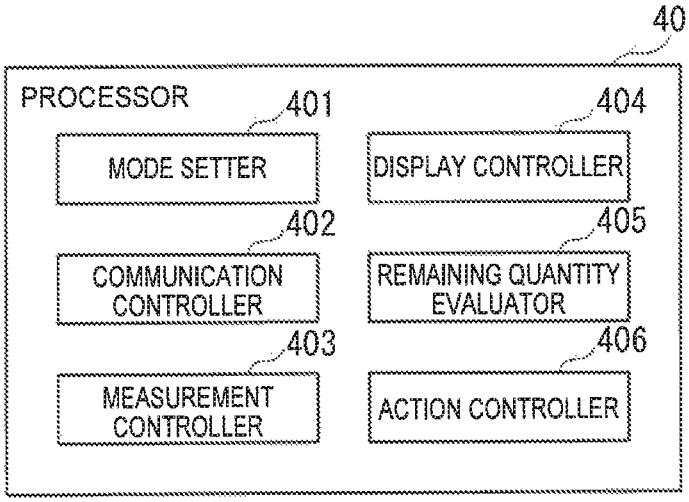
FIG. 3 is a block diagram showing the configuration of a processor in the first embodiment.

FIG. 3 is a functional block diagram showing the configuration of the processor 40.

The processor 40 includes a computation processing circuit (processor), such as a CPU (central processing unit), and controls the action of the entire timepiece 1. For example, the processor 40 carries out a process according to an operation signal inputted in response to the operation of pressing any of the switches SW described above, causes the receiver 34 and the clocker 35 described above to receive the date/time information described above and correct the current date and time, and causes the driver 37 described above to move the indicating hands H described above. The processor 40 further executes the power-saving program described above to carry out the power saving process of suppressing power consumption when the battery voltage of the secondary battery 33 is lower than the predetermined value.

To carry out the processes described above, the processor 40 includes a mode setter 401, a communication controller 402, a measurement controller 403, a display controller 404, a remaining quantity evaluator 405, and an action controller 406, as shown in FIG. 3.

The mode setter 401 sets the action mode of the timepiece 1 in accordance with input operation performed on the switch SWC described above. Specifically, when an operation signal according to the input operation is inputted to the mode setter 401, the mode setter 401 sequentially switches the action mode of the timepiece 1. As the action mode, the timepiece 1 has a basic mode, an airplane mode, an orientation display mode, an atmospheric pressure display mode, an altitude display mode, and a communication mode. The action mode set by the mode setter 401 is indicated with the mode hand H4 described above.

The basic mode is a mode that allows operation of displaying the current date and time and operation of receiving an electric wave containing the date/time information and a communication wave from an external apparatus.

The airplane mode is a mode used in an airplane and prevents electric wave reception.

The orientation display mode is a mode in which the display hand H8 indicates the orientation based on the result of the detection performed by the orientation sensor described above (orientation toward north).

The atmospheric pressure display mode is a mode in which the display hands H6 to H8 indicate the atmospheric pressure based on the result of the detection performed by the atmospheric pressure sensor described above.

The altitude display mode is a mode in which the display hands H6 to H8 indicate the altitude calculated based on the atmospheric pressure detected with the atmospheric pressure sensor described above.

The communication mode is a mode in which communication with an external apparatus is performed via the communicator 36.

The communication controller 402 controls electric wave reception performed by the receiver 34 and the communicator 36. For example, the communication controller 402 causes the receiver 34 to receive the date/time information when the action mode of the timepiece 1 is not the airplane mode and an operation signal according to input operation performed on the switch SWA described above. The communication controller 402 causes the receiver 34 to receive the date/time information when the time of the current date and time clocked by the clocker 35 reaches reserved time set in advance. The current date and time clocked by the clocker 35 is then corrected based on the date/time information.

The communication controller 402 causes the communicator 36 to perform communication with an external apparatus, such as a measuring apparatus, when the action mode of the timepiece 1 is switched to the communication mode.

The communication controller 402 prevents the electric wave reception performed by the receiver 34 and the communicator 36 when the action mode of the timepiece 1 is the airplane mode.

The measurement controller 403 controls the measurement action performed by the measuring section 38. For example, the measurement controller 403 causes the measuring section 38 to perform orientation detection with the orientation sensor when the action mode of the timepiece 1 is the orientation display mode. The measurement controller 403 causes the measuring section 38 to perform atmospheric pressure detection with the atmospheric pressure sensor when the action mode is the atmospheric pressure display mode and causes the measuring section 38 to calculate (compute) the altitude based on the detected atmospheric pressure when the action mode is the altitude display mode. Even when the action mode of the timepiece 1 is an action mode other than the display modes described above, the measurement controller 403 causes the measuring section 38 to measure the orientation, the atmospheric pressure, and the altitude on a regular basis and causes the storage 39 to store the results of the measurement.

The display controller 404 controls the movement of the indicating hands H described above performed by the driver 37 to control the display operation performed by the display 22. Specifically, the display controller 404 drives the hour/minute hand motor 371 and the second hand motor 372 to cause the hour hand H1, the minute hand H2, and the second hand H3 to indicate the current time. The display controller 404 drives the mode hand motor 373 to cause the mode hand H4 to indicate the current action mode and drives the remaining quantity hand motor 374 to cause the remaining quantity hand H5 to indicate the remaining battery level of the secondary battery 33.

When the action mode described above is any of the orientation, atmospheric pressure, and altitude display modes or when the action mode described above is the communication mode and the result of measurement can be received from the measuring apparatus (not shown), the display controller 404 drives the motors 375 and 376 to cause the display hands H6 to H8 to indicate a relevant measurement result (measured value). The display hands H6 to H8 indicate (display) numerals as described above.

The remaining quantity evaluator 405 detects the battery voltage across the secondary battery 33 to monitor the remaining battery level of the secondary battery 33 and evaluates whether or not the remaining battery level is lower than or equal to the predetermined value. Specifically, the remaining quantity evaluator 405 evaluates whether or not the remaining battery level is lower than a first threshold. When the remaining quantity evaluator 405 determines that the remaining battery level is lower than the first threshold, the remaining quantity evaluator 405 evaluates whether or not the remaining battery level is lower than a second threshold smaller than the first threshold. When the remaining quantity evaluator 405 determines that the remaining battery level is lower than the second threshold, the remaining quantity evaluator 405 further evaluates whether or not the remaining battery level is lower than a third threshold smaller than the second threshold.

The thresholds described above are set as follows: The first threshold is set, for example, to be roughly 30% the remaining battery level of the fully charged secondary battery 33; the second threshold is set, for example, to be roughly 20% the remaining battery level of the fully charged secondary battery 33; and the third threshold is set, for example, to be roughly 10% the remaining battery level of the fully charged secondary battery 33, but not necessarily, and the thresholds can each be set as appropriate.

The remaining battery level of the secondary battery 33 is indicated with the remaining quantity hand H5, which is caused to pivot by the driver 37.

The action controller 406 controls the action of the timepiece 1 in such a way that the power consumption is suppressed when the remaining battery level lowers.

In the present embodiment, based on the remaining battery level of the secondary battery 33, the action controller 406 restricts action modes to which the mode setter 401 can switch the current action mode.

Specifically, when the remaining quantity evaluator 405 determines that the remaining battery level of the secondary battery 33 is lower than the first threshold described above, the action controller 406 prevents switching to the orientation display mode out of the action modes described above. As a result, the orientation display operation performed by the driver 37 and the display hands H6 to H8 described above is not performed. Further, in this state, the action controller 406 controls the measurement controller 403 to cause the orientation sensor in the measuring section 38 to stop operating.

When the remaining quantity evaluator 405 determines that the remaining battery level is lower than the second threshold described above, the action controller 406 prevents switching to the altitude display mode as well as the orientation display mode. As a result, the orientation and altitude display operation performed by the driver 37 and the display hands H6 to H8 described above is not performed. Further, in this state, the action controller 406 controls the measurement controller 403 to not only cause the orientation sensor described above to stop operating but stop the computation of the altitude based on the result of the detection performed by the atmospheric pressure sensor described above.

Further, when the remaining quantity evaluator 405 determines that the remaining battery level is lower than the third threshold described above, the action controller 406 prevents switching to the atmospheric pressure display mode as well as the orientation display mode and the altitude display mode. As a result, the orientation, altitude, and atmospheric pressure display operation performed by the driver 37 and the display hands H6 to H8 described above is not performed. Further, in this state, the action controller 406 controls the measurement controller 403 to not only cause the orientation sensor and the atmospheric pressure sensor described above to stop operating but stop the computation of the altitude.

The reason why the action controller 406 sequentially prevents switching to the orientation display mode, the altitude display mode, and the atmospheric pressure display mode in accordance with the remaining battery level as described above is that based on the fact that the detection of the orientation requires the highest consumed power and the detection of the atmospheric pressure requires the lowest consumed power out of the detection of the orientation, the altitude, and the atmospheric pressure detection, the detection of the atmospheric pressure, which requires the lowest consumed power, is delayed as much as possible.

Even in the case where the remaining battery level of the secondary battery 33 is low, the user desires to check the measurement results described above in some cases. In such cases, and in a case where the timepiece 1 is configured to be capable of forcible measurement of the measurement items measurable by the measuring section 38 (orientation, altitude, and atmospheric pressure in present embodiment) in accordance with the user's input operation performed on any of the switches SW, the consumed power may be lowered in accordance with the remaining battery level as follows.

For example, in the case where it is determined that the remaining battery level is lower than the third threshold, the action controller 406 controls the measurement controller 403 to shorten any of the measurement periods for which the measuring section 38 performs the measurement. Specifically, when the measurement period in the case where the remaining battery level is higher than or equal to the third threshold is 1 minute and it is determined that the remaining battery level is lower than the third threshold, the action controller 406 sets the measurement period at 30 seconds. The power consumed by the timepiece 1 can therefore be suppressed. The measurement period can be changed as appropriate.

Further, in the case where the timepiece 1 measures the measurement items measurable by the measuring section 38 on a regular basis irrespective of the action mode, as described above, the action controller 406 may lower the consumed power in accordance with the remaining battery level as follows.

For example, in the case where it is determined that the remaining battery level is lower than the third threshold, the action controller 406 controls the measurement controller 403 to lengthen the measurement cycle in accordance with which the measurement items described above are each measured. Specifically, when the measurement cycle in the case where the remaining battery level is higher than or equal to the third threshold is 10 minutes (in a case where the measurement items are each measured every 10 minutes) and the remaining battery level is lower than the third threshold, the action controller 406 sets the measurement cycle at 30 minutes. The power consumption of the timepiece 1 can therefore be suppressed. The measurement cycle can be changed as appropriate.

In addition to the above, the action controller 406 controls the action in the communication mode as well as the prevention of the action mode switching according to the remaining battery level. Specifically, when the action mode described above is set to be the communication mode for communication with an external apparatus, such as a measuring apparatus, and it is determined that the remaining battery level is lower than the first threshold, the action controller 406 controls the communication controller 402 to causes the communication period for which the communicator 36 communicates with the external apparatus to be shorter than the communication period in the case where the remaining battery level is higher than or equal to the first threshold. For example, when the communication period in the case where the remaining battery level is higher than or equal to the first threshold is 1 minute, and it is determined that the remaining battery level is lower than the first threshold, the action controller 406 changes the communication period to 30 seconds. Further, when it is determined that the remaining battery level is lower than the third threshold, the action controller 406 prevents the switching to the communication mode to prevent the communicator 36 from communicating with the external apparatus. The power consumption of the timepiece 1 can therefore be suppressed. The thresholds in this case can be changed as appropriate.

In a case where the charger 32 charges the secondary battery 33 and the remaining battery level of the secondary battery 33 increases accordingly, the preventions imposed by the action controller 406 are sequentially lifted.

Specifically, when the remaining battery level becomes higher than or equal to the third threshold described above, the action controller 406 lifts the prevention imposed by the action controller 406 when the remaining battery level became lower than the third threshold. When the remaining battery level becomes higher than or equal to the second threshold described above, the action controller 406 lifts the prevention imposed by the action controller 406 when the remaining battery level became lower than the second threshold. Further, when the remaining battery level becomes higher than or equal to the first threshold described above, the action controller 406 lifts all the preventions.

Power Saving Process

Figure 4:
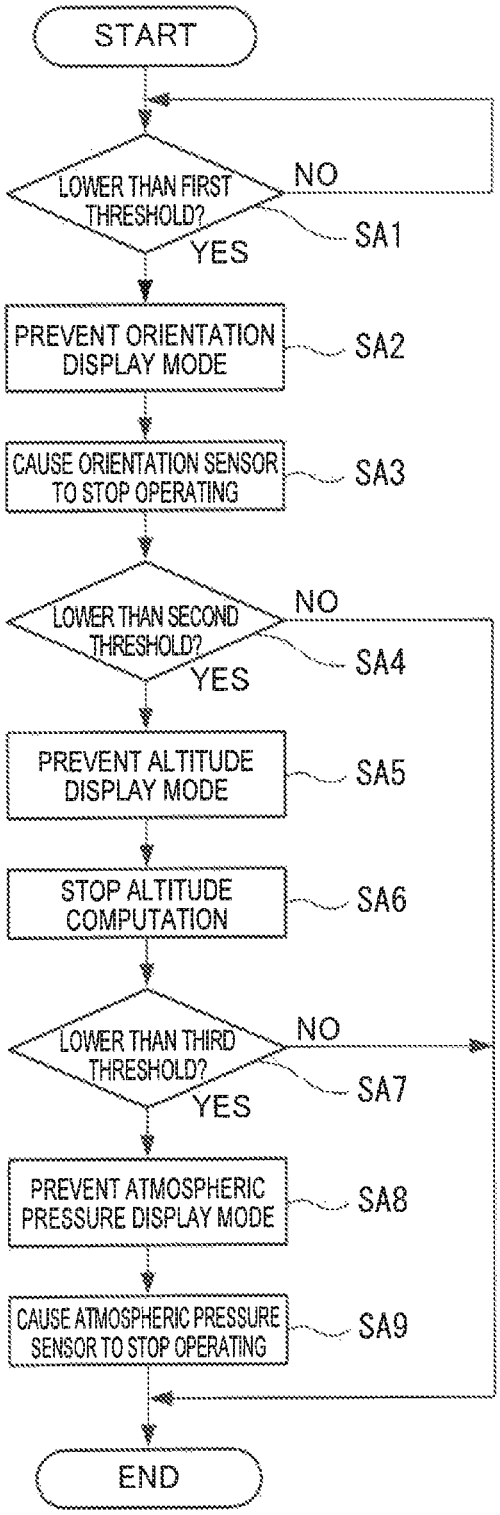
FIG. 4 is a flowchart showing a power saving process in the first embodiment.

FIG. 4 is a flowchart showing the power saving process carried out by the processor 40.

The processor 40 described above executes the power-saving program stored in the storage 39 to carry out the power saving process for function restriction according to the remaining battery level of the secondary battery 33.

In the power saving process, the remaining quantity evaluator 405 first evaluates whether or not the remaining battery level of the secondary battery 33 is lower than the first threshold described above (step SA1), as shown in FIG. 4.

When the remaining quantity evaluator 405 determines in the evaluation process in step SA1 that the remaining battery level is not lower than the first threshold, that is, the remaining battery level is higher than or equal to the first threshold (NO in step SA1), the processor 40 returns to the process in step SA1. In this case, the remaining quantity evaluator 405 repeatedly monitors the remaining battery level on a predetermined interval basis.

On the other hand, when the remaining quantity evaluator 405 determines in the evaluation process in step SA1 that the remaining battery level is lower than the first threshold (YES in step SA1), the action controller 406 controls the mode setter 401 to prevent switching to the orientation display mode (step SA2). The action controller 406 further controls the measurement controller 403 to cause the orientation sensor, which forms the measuring section 38, to stop operating (step SA3).

The remaining quantity evaluator 405 then evaluates whether or not the remaining battery level is lower than the second threshold (step SA4).

When the remaining quantity evaluator 405 determines in the evaluation process in step SA4 that the remaining battery level is not lower than the second threshold, that is, the remaining battery level is higher than or equal to the second threshold (NO in step SA4), the processor 40 terminates the power saving process. As described above, when the remaining battery level is lower than the first threshold but higher than or equal to the second threshold, the switching to the orientation display mode is not allowed, and the orientation sensor is caused to stop operating.

On the other hand, when the remaining quantity evaluator 405 determines in the evaluation process in step SA4 that the remaining battery level is lower than the second threshold (YES in step SA4), the action controller 406 controls the mode setter 401 to prevent switching to the altitude display mode (step SA5). The action controller 406 further controls the measurement controller 403 to stop the computation of the altitude based on the atmospheric pressure detected with the atmospheric pressure sensor (step SA6).

The remaining quantity evaluator 405 then evaluates whether or not the remaining battery level is lower than the third threshold (step SA7).

When the remaining quantity evaluator 405 determines in the evaluation process in step SA7 that the remaining battery level is not lower than the third threshold, that is, the remaining battery level is higher than or equal to the third threshold (NO in step SA7), the processor 40 terminates the power saving process. As described above, when the remaining battery level is lower than the second threshold but higher than or equal to the third threshold, the switching to the orientation display mode and the switching to the altitude display mode are not allowed, the orientation sensor is caused to stop operating, and the altitude is not computed.

On the other hand, when the remaining quantity evaluator 405 determines in the evaluation process in step SA7 that the remaining battery level is lower than the third threshold (YES in step SA7), the action controller 406 controls the mode setter 401 to prevent switching to the atmospheric pressure display mode (step SA8). The action controller 406 further controls the measurement controller 403 to cause the atmospheric pressure sensor to stop operating (step SA9). As described above, when the remaining battery level is lower than the third threshold, the switching to the orientation display mode, the switching to the altitude display mode, and the switching to the atmospheric pressure display mode are not allowed, the orientation sensor and the atmospheric pressure sensor are caused to stop operating, and the altitude is not computed.

When steps SA8 and SA9 are completed, the processor 40 terminates the power saving process.

The power saving process described above may include the process of changing the measurement periods, the measurement cycle, and the communication period described above.

Effects of First Embodiment

The electronic timepiece 1 according to the present embodiment described above provides the following effects.

When the remaining battery level of the secondary battery 33 is lower than the first threshold, the switching to the orientation display mode is not allowed. When the remaining battery level is lower than the second threshold smaller than the first threshold, the switching to the altitude display mode is not allowed in addition to the orientation display mode. Further, when the remaining battery level is lower than the third threshold smaller than the second threshold, the switching to the atmospheric pressure display mode is not allowed in addition to the orientation display mode and the altitude display mode. Consumption of electric power required when measurement results (measured values) are displayed with the display hands H6 to H8 in the display modes described above can thus be suppressed. The power consumption of the electronic timepiece 1 can therefore be suppressed.

The action controller 406 causes the orientation sensor in the measuring section 38 to stop operating to prevent measurement of the orientation when the remaining battery level of the secondary battery 33 is lower than the first threshold described above. The action controller 406 further stops the computation of the altitude to prevent the measurement of the altitude when the remaining battery level is lower than the second threshold described above and causes the atmospheric pressure sensor in the measuring section 38 to stop operating to prevent the measurement of the atmospheric pressure when the remaining battery level is lower than the third threshold described above. As a result, not only is the display 22 not allowed to display a measurement result, but the measuring section 38 is not allowed to perform the measurement, whereby the power consumption of the electronic timepiece 1 can be further suppressed.

Out of the orientation, the altitude, and the atmospheric pressure, the measurement of the orientation requires the highest electric power, and the measurement of the atmospheric pressure requires the lowest electric power. Since the prevention of the switching to the display modes is performed in the descending order of the consumed power, the duration of the electronic timepiece 1 can be prolonged.

Second Embodiment

A second embodiment of the invention will next be described.

An electronic timepiece according to the present embodiment has the same configuration as that of the electronic timepiece 1 described above. In the electronic timepiece 1, the power consumption is suppressed by preventing the switching to the orientation, altitude, and atmospheric pressure display modes in accordance with the remaining battery level. In contrast, in the electronic timepiece according to the present embodiment, the power consumption is suppressed by displaying no upper or lower two digits of a measured value when the altitude or atmospheric pressure is displayed. The electronic timepiece according to the present embodiment differs from the electronic timepiece 1 in this regard. In the following description, the same portions or roughly the same portions as those having already been described have the same reference characters and will not be described.

Figure 5:
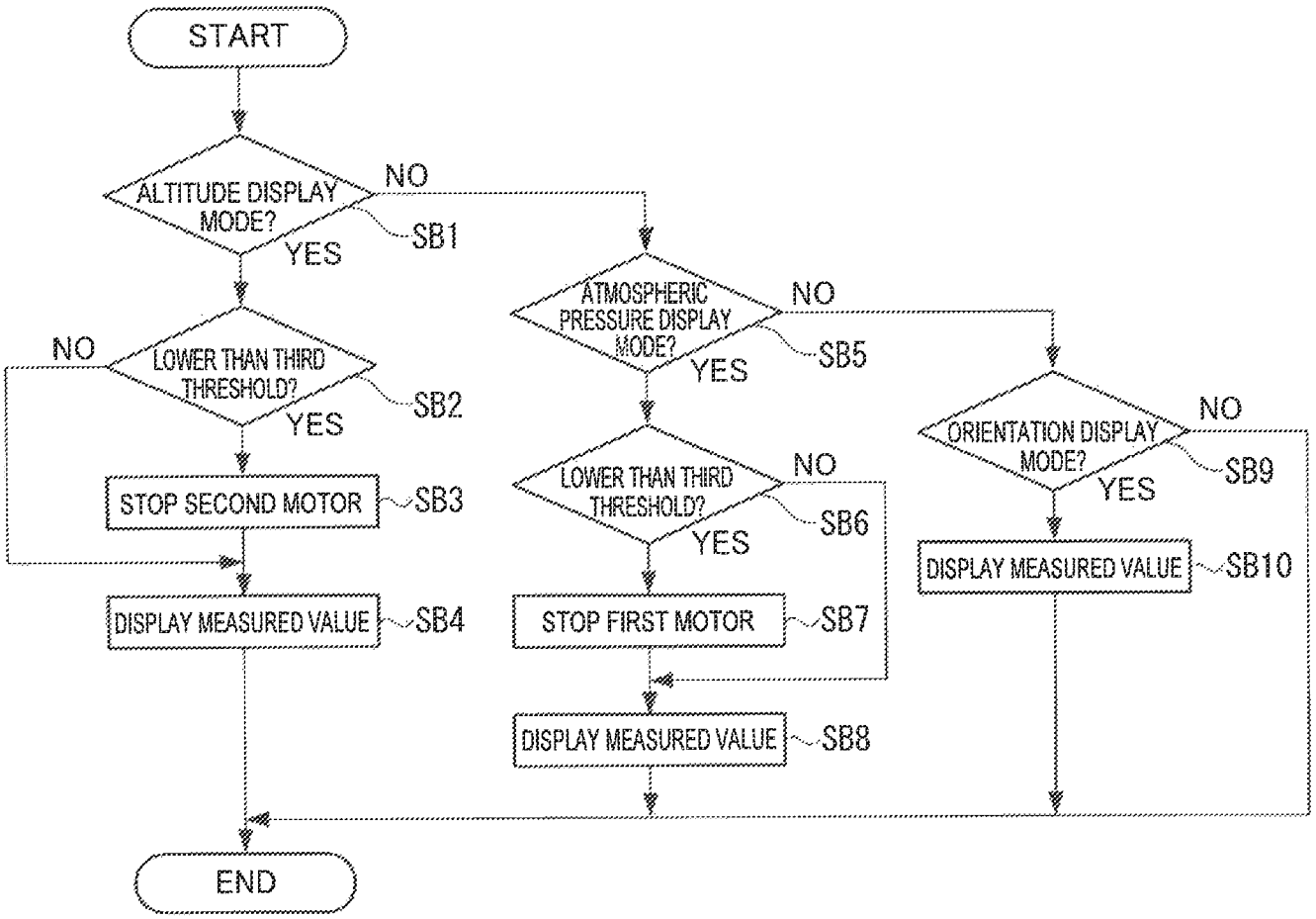
FIG. 5 is a flowchart showing the power saving process carried out by an electronic timepiece according to a second embodiment of the invention.

FIG. 5 is a flowchart showing the power saving process carried out by the processor 40 of the electronic timepiece according to the present embodiment.

The electronic timepiece according to the present embodiment has the same configuration as that of the electronic timepiece 1 described above, but the processor 40 executes the power saving program stored in the storage 39 to carry out the power saving process shown in FIG. 5. The power saving process is a power consumption suppressing process of causing the first motor 375 or the second motor 376 to stop operating when the altitude or the atmospheric pressure is displayed so that the upper or lower two digits are not indicated.

In the power saving process, the action controller 406 first evaluates whether or not the current action mode is the altitude display mode (step SB1), as shown in FIG. 5.

When the action controller 406 determines in the evaluation process in step SB1 that the current action mode is the altitude display mode (YES in step SB1), the remaining quantity evaluator 405 evaluates whether or not the remaining battery level of the secondary battery 33 is lower than the third threshold described above (step SB2).

When the remaining quantity evaluator 405 determines in the evaluation process in step SB2 that the remaining battery level is not lower than the third threshold, that is, the remaining battery level is higher than or equal to the third threshold (NO in step SB2), the processor 40 proceeds to the process in step SB4.

On the other hand, when the remaining quantity evaluator 405 determines in the evaluation process in step SB2 that the remaining battery level is lower than the third threshold (YES in step SB2), the action controller 406 controls the display controller 404 to stop the second motor 376, which causes the display hand H8 described above to pivot, (step SB3). The processor 40 then proceeds to the process in step SB4.

In step SB4, the display controller 404 displays the result of the measurement (measured value) of the altitude measured by the measuring section 38 (step SB4).

In this process, in the case where the processor 40 has not undergone step SB3 described above, that is, in the case where the remaining battery level is higher than or equal to the third threshold, the first motor 375 and the second motor 376 are each active, whereby the display hands H6 to H8 indicate the measured value of the altitude.

On the other hand, in a case where the processor 40 has undergone step SB3 described above so that the second motor 376 is not in operation, only the upper two digits of the four-digit measured value are indicated with the display hands H6 and H7, which are caused to pivot with the first motor 375, but the lower two digits are not indicated. In this case, the position of the display hand H8 is the initial position (position indicating 12-o'clock direction) or the position where the display hand H8 indicates the lower two digits of the preceding measured value. The electric power consumed when the altitude is displayed is therefore lowered because the display hand H8 is not caused to pivot.

After step SB4 described above, the processor 40 terminates the power saving process.

When the action controller 406 determines in the evaluation process in step SB1 described above that the current action mode is not the altitude display mode (NO in step SB1), the action controller 406 evaluates whether or not the current action mode is the atmospheric pressure display mode (step SB5).

When the action controller 406 determines in the evaluation process in step SB5 that the current action mode is the atmospheric pressure display mode (YES in step SB5), the remaining quantity evaluator 405 evaluates whether or not the remaining battery level of the secondary battery 33 is lower than the third threshold described above (step SB6).

When the remaining quantity evaluator 405 determines in the evaluation process in step SB6 that the remaining battery level is not lower than the third threshold, that is, the remaining battery level is higher than or equal to the third threshold (NO in step SB6), the processor 40 proceeds to the process in step SB8.

On the other hand, when the remaining quantity evaluator 405 determines in the evaluation process in step SB6 that the remaining battery level is lower than the third threshold (YES in step SB6), the action controller 406 controls the display controller 404 to stop the first motor 375, which causes the display hands H6 and H7 described above to pivot, (step SB7). The processor 40 then proceeds to the process in step SB8.

In step SB8, the display controller 404 displays the result of the measurement (measured value) of the atmospheric pressure measured by the measuring section 38 (step SB8), as in step SB4 described above.

In this process, in the case where the processor 40 has not undergone step SB7 described above, that is, in the case where the remaining battery level is higher than or equal to the third threshold, the first motor 375 and the second motor 376 are each active, whereby the display hands H6 to H8 indicate the measured value of the atmospheric pressure.

On the other hand, in the case where the processor 40 has undergone step SB7 described above so that the first motor 375 is not in operation, only the lower two digits of the four-digit measured value are indicated with the display hand H8, which is caused to pivot with the second motor 376, but the upper two digits are not indicated. Also in this case, the positions of the display hands H6 and H7 are the initial position (position indicating 12-o'clock direction) or the positions where the display hands H6 and H7 indicate the upper two digits of the preceding measured value. The electric power consumed when the atmospheric pressure is displayed is therefore lowered.

After the step SB8 described above, the processor 40 terminates the power saving process.

When the action controller 406 determines in the evaluation process in step SB5 described above that the current action mode is not the atmospheric pressure display mode (NO in step SB5), the action controller 406 evaluates whether or not the current action mode is the orientation display mode (step SB9).

When the action controller 406 determines in the evaluation process that the current action mode is not the orientation display mode (NO in step SB9), the current display mode is any of the basic mode, the airplane mode, and the communication mode. In this case, since no power consumption suppressing process is carried out in the present embodiment, the processor 40 terminates the power saving process.

On the other hand, when the action controller 406 determines in the evaluation process in step SB9 that the current action mode is the orientation display mode (YES in step SB9), the action controller 406 controls the display controller 404 to cause the display hand H8 to indicate the result of the measurement (measured value) of the orientation measured by the measuring section 38 (step SB10). After step SB10, the processor 40 terminates the power saving process.

The thus configured power saving process is repeatedly carried out at predetermined intervals.

In step SB3 described above, the second motor 376 is caused to stop operating, and in step SB7 described above, the first motor 375 is caused to stop operating. The motors caused to stop operating in steps SB3 and SB7 may be reversed, or the same motor may be caused to stop operating in steps SB3 and SB7.

In mountain climbing, for example, the altitude and the atmospheric pressure are checked at a relatively high frequency. Regarding the altitude, however, the upper two digits are more important than the lower two digits, whereas regarding the atmospheric pressure, the lower two digits are more important than the upper two digits. Therefore, when the motor to be caused to stop operating when the remaining battery level lowers is specified in accordance with the measurement item the measurement result of which is displayed, the consumed power can be lowered with necessary information displayed.

On the other hand, in the orientation display mode, since the orientation is indicated with the display hand H8, the first motor 375, which causes the display hands H6 and H7 to pivot, is caused to stop operating, and the hand movement therefore does not consume a large amount of electric power. Therefore, in the power saving process described above, when the current action mode is the orientation display mode, the display hand H8 indicates the orientation irrespective of the remaining battery level. However, also in the power saving process in the present embodiment, the switching to the orientation display mode may not be allowed in accordance with the remaining battery level, as in the power saving process in the first embodiment described above.

Effects of Second Embodiment

The electronic timepiece according to the present embodiment described above can provide not only the same effects as those provided by the electronic timepiece 1 described above but the following effects.

The electronic timepiece according to the present embodiment includes the measuring section 38, the secondary battery 33 (battery), which supplies electric power for driving at least the measuring section 38 and the display 22 (drive electric power), the display 22, and the processor 40, which controls the entire timepiece. Out of the components described above, the display 22 includes the display hands H6 to H8, which display the results of the measurement performed by the measuring section 38, and out of the display hands, the display hands H6 and H7 (upper digit display hands) indicate the numerals at the upper two digits of the displayed four-digit altitude and atmospheric pressure, and the display hand H8 (lower digit display hand) indicates the numerals at the lower two digits. When the action mode is the altitude display mode, the action controller 406 provided in the processor 40 stops the second motor 376 when the remaining battery level of the secondary battery 33 is lower than the predetermined value (third threshold) to prevent the display hand H8 from displaying the lower two digits of a measured value but causes the display hands H6 and H7 to display the upper two digits of the measured value. On the other hand, when the action mode is the atmospheric pressure display mode, the action controller 406 stops the first motor 375 when the remaining battery level is lower than the predetermined value (third threshold) to prevent the display hands H6 and H7 from displaying the upper two digits of a measured value but causes the display hand H8 to display the lower two digits of the measured value. According to the operation described above, the electric power necessary for the operation of driving one of the display hands H6/H7 and the display hand H8 is not consumed. The power consumption of the electronic timepiece can therefore be suppressed.

When the remaining battery level is lower than the predetermined value (third threshold), and the altitude out of the plurality of measurement items measureable by the measuring section 38 is displayed, the display hand H8 is not allowed to display the lower two digits of the measured altitude, and when the atmospheric pressure is displayed, the display hands H6 and H7 are not allowed to display the upper two digits of the measured atmospheric pressure. As a result, preventing a display hand other than a display hand that displays a digit where a large change occurs or which is important in a measurement item from displaying a measured value allows suppression of the power consumption of the electronic timepiece with a minimum numeral required in the measurement displayed.

Third Embodiment

A third embodiment of the invention will next be described.

An electronic timepiece according to the present embodiment has the same configuration as that of the electronic timepiece 1 described above. The electronic timepiece according to the present embodiment, when it displays the result of any of the measurement items measured by the measuring section 38, suppresses power consumption by displaying the average of measured values measured multiple times in accordance with the number according to the remaining battery level as the measurement result. The electronic timepiece according to the present embodiment differs from the electronic timepiece 1 described above in this regard. In the following description, the same portions or roughly the same portions as those having already been described have the same reference characters and will not be described.

Figure 6:
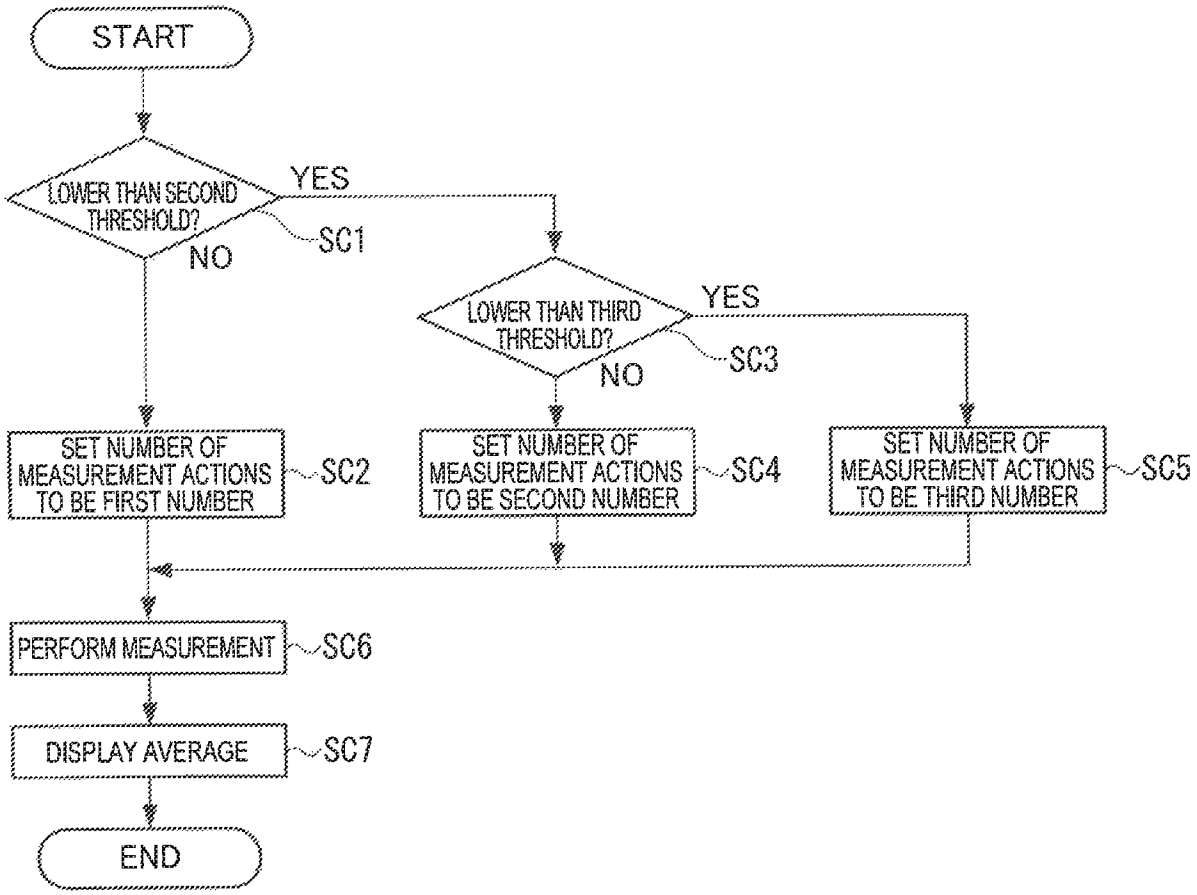
FIG. 6 is a flowchart showing the power saving process carried out by an electronic timepiece according to a third embodiment of the invention.

FIG. 6 is a flowchart showing the power saving process carried out by the processor 40 of the electronic timepiece according to the present embodiment.

The electronic timepiece according to the present embodiment has the same configuration as that of the electronic timepiece 1 described above. In the electronic timepiece, the processor 40 executes the power saving program stored in the storage 39 to carry out the power saving process shown in FIG. 6. The power saving process is a power consumption suppressing process that is carried out when the action mode is set to be any of the orientation display mode, the altitude display mode, and the atmospheric pressure display mode described above (that is, when the measurement result of a measurement item measurable by measuring section 38 is displayed) and displays the average of measured values measured multiple times in accordance with the number according to the remaining battery level as the measurement result.

The power saving process will be described below.

In the power saving process in the present embodiment, the remaining quantity evaluator 405 first evaluates whether or not the remaining battery level of the secondary battery 33 is lower than the second threshold (step SC1), as shown in FIG. 6.

When the remaining quantity evaluator 405 determines in the evaluation process that the remaining battery level is not lower than the second threshold, that is, the remaining battery level is higher than or equal to the second threshold (NO in step SC1), the action controller 406 sets the number of measurement actions for obtaining the average as the measurement result to be a first number (step SC2). The first number is set at 5 in the present embodiment.

The processor 40 then proceeds to the process in step SC6.

When the remaining quantity evaluator 405 determines in the evaluation process in step SC1 described above that the remaining battery level is lower than the second threshold (YES in step SC1), the remaining quantity evaluator 405 evaluates whether or not the remaining battery level is lower than the third threshold (step SC3).

When the remaining quantity evaluator 405 determines in the evaluation process that the remaining battery level is not lower than the third threshold, that is, the remaining battery level is higher than or equal to the third threshold (NO in step SC3), the action controller 406 sets the number of measurement actions described above to be a second number that is smaller than the first number described above (step SC4). The second number is set at 3 in the present embodiment.

The processor 40 then proceeds to the process in step SC6.

When the remaining quantity evaluator 405 determines in the evaluation process in step SC3 described above that the remaining battery level is lower than the third threshold (YES in step SC3), the action controller 406 sets the number of measurement actions described above to be a third number that is smaller than the second number described above (step SC5). The third number is set at 1 in the present embodiment.

The processor 40 then proceeds to the process in step SC6.

In step SC6, the action controller 406 instructs the measurement controller 403 to cause the measuring section 38 to measure the relevant measurement item by the number of measurement actions described above (step SC6). For example, in a case where the current action mode is the atmospheric pressure display mode, and the set number of measurement actions is the second number described above, the action controller 406 causes the measuring section 38 to measure the atmospheric pressure 3 times.

The action controller 406 then controls the measurement controller 403 to cause the measuring section 38 to calculate the average of the measured values measured by the number of performed measurement actions and controls the display controller 404 to cause the display 22 to display the average as the measurement result (step SC7). Specifically, after the average is calculated, the action controller 406 causes the first motor 375 and the second motor 376 of the driver 37 via the display controller 404 to cause the display hands H6 to H8 (display hand H8 in the case where the orientation is displayed) for indication of the average.

After step SC7, the processor 40 terminates the power saving process.

Effects of Third Embodiment

The electronic timepiece according to the present embodiment described above can provide not only the same effects as those provided by the electronic timepiece 1 described above but the following effects.

The electronic timepiece according to the present embodiment includes the measuring section 38, which measures the orientation, the altitude, and the atmospheric pressure, the secondary battery 33 (battery), which supplies electric power for driving at least the measuring section 38 and the display 22 (drive electric power), the display 22, which includes the display hands H6 to H8, which indicate the result of measurement performed by the measuring section 38, and the processor 40, which controls the action of the entire timepiece. Among them, the action controller 406 of the processor 40 causes the display hands H6 to H8 to indicate the average of 5 measured values in the case where the remaining battery level of the secondary battery 33 is higher than or equal to the second threshold. On the other hand, the action controller 406 causes the display hands H6 to H8 to indicate the average of 3 measured values in the case where the remaining battery level is lower than the second threshold but higher than or equal to the third threshold and causes the display hands H6 to H8 to indicate 1 measured value in the case where the remaining battery level is lower than the third threshold. The number of measured values used to calculate the average can thus be reduced. Therefore, when the remaining battery level is lower than the second threshold, the consumed power necessary for the computation of the average can be lowered as compared with the case where the remaining battery level is higher than or equal to the second threshold, whereby the power consumption of the electronic timepiece can be suppressed.

The action controller 406 causes the measuring section 38 to perform measurement five times when the remaining battery level is higher than or equal to the second threshold, causes the measuring section 38 to perform measurement three times when the remaining battery level is lower than the second threshold but higher than or equal to the third threshold, and causes the measuring section 38 to perform measurement once when the remaining battery level is lower than the third threshold. The number of measurement actions performed by the measuring section 38 can therefore be reduced in accordance with the remaining battery level. The power consumption of the electronic timepiece can therefore be lowered.

Variations of Embodiments

The invention is not limited to the embodiments described above, and changes, improvements, and other modifications to the extent that they can achieve the advantage of the invention fall within the scope of the invention.

The power consumption is further suppressed when the remaining battery level is small by preventing the switching of the action mode from one to another in the first embodiment described above, preventing the display hands H6 to H8 from displaying a measurement result (measured value) in the second embodiment described above, and setting the number of measured values used to calculate the average and the number of measurement actions in the third embodiment described above. Further, in the first embodiment described above, the measurement period and measurement cycle are changed and the communication period is shortened in accordance with the remaining battery level. These processes of suppressing power consumption may be combined with one another.

For example, in the second embodiment described above, in the case where the action mode of the electronic timepiece is the orientation display mode, the display hand H8 indicates the orientation irrespective of the remaining battery level of the secondary battery 33. In contrast, when the remaining battery level is lower than the third threshold, the switching to the orientation display mode may not be allowed.

In the first embodiment described above, the remaining battery level of the secondary battery 33 is compared with the first to third thresholds, in the second embodiment described above, the remaining battery level is compared with the third threshold, and in the third embodiment described above, the remaining battery level is compared with the second and third thresholds, but not necessarily in the invention.

For example, in the first embodiment described above, the remaining battery level may instead be compared with one or two of the first to third thresholds. In the case where the number of thresholds that each serve as an index is one, and the remaining battery level is lower than that threshold, the switching to any of the display modes may not be allowed. Further, among the display modes in which the measurement items measurable by the measuring section 38 are displayed, when at least one of the display modes is not allowed in accordance with the remaining battery level, the other display modes may be allowed. Moreover, the order in accordance with which the display modes are not allowed can be changed as appropriate. For example, in the case where the remaining battery level is lower than the first threshold, the switching to the altitude display mode may first not be allowed.

In the second embodiment described above, the remaining battery level may instead be compared with the first or second threshold, and in the third embodiment described above, the remaining battery level may instead be compared with the first and second thresholds or the first and third thresholds.

The remaining battery level corresponding to each of the first to third thresholds can be changed as appropriate, as described above.

In the first embodiment described above, when the switching to a display mode in which a measurement result of a predetermined measurement item is displayed is not allowed in accordance with the remaining battery level, the measurement of the measurement item performed by the measuring section 38 is also not performed, but not necessarily, and the measurement performed by the measuring section 38 (regular measurement, for example) may be continued even when the switching of the action mode is not allowed.

In each of the embodiments described above, the display hands that indicate the result of measurement (measured values) performed by the measuring section 38 and the result of measurement (measured value) performed by a measuring apparatus that is an external apparatus are the display hands H6 to H8. The display hand H6 indicates the numeral at the upper first digit of a measured value, the display hand H7 indicates the numeral at the upper second digit of the measured value, and the display hand H8 indicates the numerals at the upper third and fourth digits (lower two digits) of the measured value, but not necessarily, and the number of display hands that indicate a measured value can be changed as appropriate. For example, in the case where a four-digit measured value is displayed, a display hand may be provided on a digit basis, or the display 22 may be provided with one display hand that indicates the numerals at the upper two digits and one display hand that indicates the numerals at the lower two digits. In this case, in the second embodiment described above, operation of displaying the numerals indicated with one of the two display hands may not be allowed. Further, a measured value is not limited to a four-digit value and may, for example, be a three-digit value in a case where the pulse rate is indicated. In addition, the indicating hands that indicate a measurement result may include at least any of the hour hand H1, the minute hand H2, and the second hand H3.

In place of or in addition to the display hands H6 to H8, the display 22 may be provided with a display that indicates the measurement item (measured value).

In each of the embodiments described above, as the battery that supplies the drive electric power, the secondary battery 33, which the charger 32 can charge by using the electric power generated by the power generator 31, is presented, but not necessarily, and a primary battery may be used as the battery. In this case, the power generator 31 and the charger 32 can be omitted.

In each of the embodiments described above, the measuring section 38 measures the orientation, the altitude, and the atmospheric pressure based on the results of the detection performed by the orientation sensor and the atmospheric pressure sensor, but not necessarily. For example, another sensor may be provided, and the measuring section 38 may be configured to be capable of measuring another measurement item in place of or in addition to the orientation, the altitude, and the atmospheric pressure, as described above.

In each of the embodiments described above, the display 22 includes the dial 23, on which the indicating hands H and the small windows 24 to 26 are disposed in the layout shown in FIG. 1, but not necessarily, and the layout of the dial 23 can be changed as appropriate.

In each of the embodiments described above, the electronic timepiece includes the receiver 34 and the communicator 36, but not necessarily, and in a case where an electric wave transmitted from an external apparatus is not received, the receiver 34 and the communicator 36 can be omitted. That is, the receiver 34 and the communicator 36 are not each an essential component. Further, the electronic timepiece may be configured to communicate with an external apparatus via a wire.

What is claimed is:

1. An electronic timepiece comprising:

at least one sensor that measures a predetermined measurement item;

a display capable of displaying a result of the measurement performed by the at least one sensor;

a battery that supplies electric power for driving the at least one sensor and the display; and a processor that controls an action of the entire electronic timepiece, wherein the processor causes the display to display an average of results of the measurement performed multiple times in accordance with a first number when a remaining battery level of the battery is higher than or equal to a predetermined value, and causes the display to display an average of results of the measurement performed multiple times in accordance with a second number smaller than the first number when the remaining battery level is lower than the predetermined value.

2. The electronic timepiece according to claim 1, wherein the processor causes the at least one sensor to perform the measurement multiple times in accordance with the first number when the remaining battery level is higher than or equal to the predetermined value, and causes the at least one sensor to perform the measurement multiple times in accordance with the second number when the remaining battery level is lower than the predetermined value.

3. A method for controlling an electronic timepiece including at least one sensor that measures a predetermined measurement item, a display capable of displaying a result of the measurement performed by the at least one sensor, and a battery that supplies electric power for driving the at least one sensor and the display, the method comprising:

displaying an average of results of the measurement performed multiple times in accordance with a first number when a remaining battery level of the battery is higher than or equal to a predetermined value, and displaying an average of results of the measurement performed multiple times in accordance with a second number smaller than the first number when the remaining battery level is lower than the predetermined value.

* * * * *